United States Patent [19]

Sevigny

[11] Patent Number: 4,823,428

[45] Date of Patent: Apr. 25, 1989

[54] WASTE LIQUID DISPOSAL APPARATUS

[76] Inventor: Conrad Sevigny, 1555 Castelneau, Quebec, Canada, J2S 7K6

[21] Appl. No.: 556,528

[22] Filed: Nov. 30, 1983

Related U.S. Application Data

[63] Continuation-in-part of Ser. No. 423,360, Sep. 24, 1982, abandoned.

[30] Foreign Application Priority Data

Sep. 27, 1982 [CA] Canada ..... 41213

[51] Int. Cl.[4] ..... A47L 5/38

[52] U.S. Cl. ..... 15/302; 4/508; 4/665; 15/314; 15/353; 137/205

[58] Field of Search ..... 134/10, 21; 15/321, 15/348, 353, 302, 314; 137/205; 4/661, 508, 665, 666

[56] References Cited

U.S. PATENT DOCUMENTS

| | | | |
|---|---|---|---|
| 768,878 | 8/1904 | Legg | 4/665 |
| 882,760 | 3/1908 | Hubert | 4/665 |
| 3,537,111 | 11/1970 | Whitten | 4/508 |
| 4,158,575 | 6/1979 | Townsend | 134/10 |
| 4,184,506 | 1/1980 | Varis et al. | 137/205 |
| 4,226,000 | 10/1980 | Tribolet | 15/353 |
| 4,293,300 | 10/1981 | Cattani | 137/205 |

*Primary Examiner*—David L. Lacey
*Attorney, Agent, or Firm*—Edwin E. Greigg

[57] ABSTRACT

An apparatus for disposing of waste liquid from an industrial cleaning system, which comprises a waste liquid holding tank designed to fit on a toilet, for receiving waste liquid and automatically emptying the waste liquid from the holding tank into the toilet when the holding tank is full.

9 Claims, 3 Drawing Sheets

WASTE LIQUID DISPOSAL APPARATUS

Figure 1:
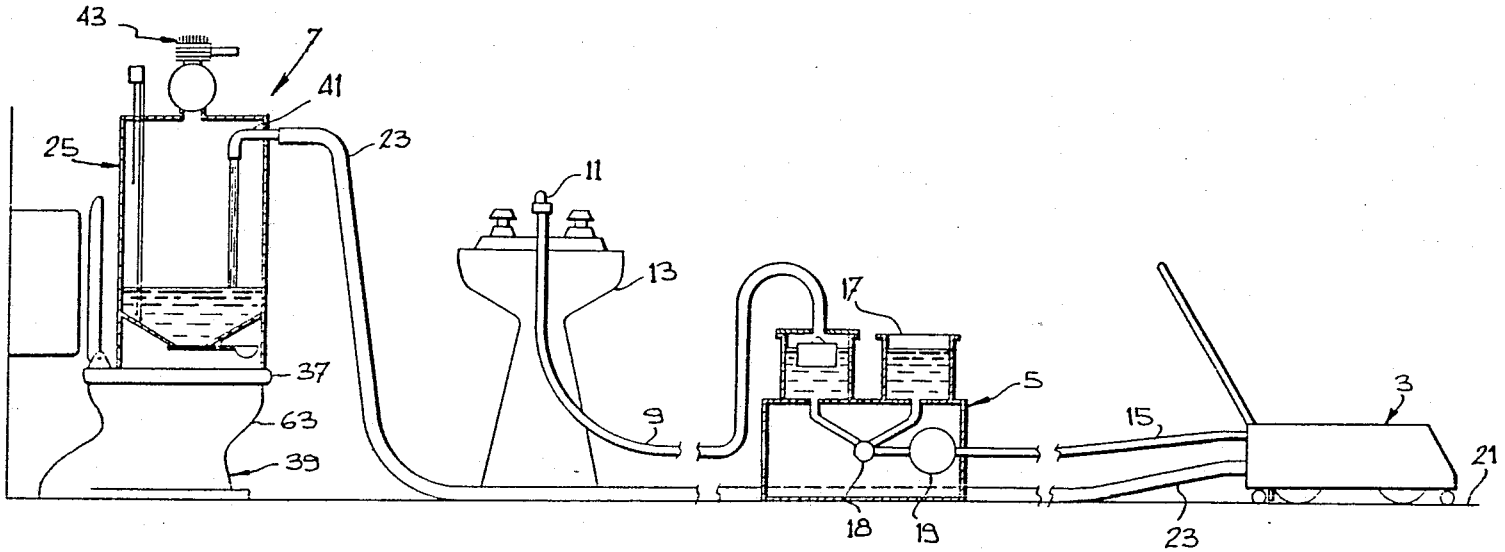

This is a continuation-in-part application of application Ser. No. 423,360 filed on Sept. 24, 1982, now abandoned.

The present invention relates a waste liquid disposal apparatus. The invention more particularly relates to a waste liquid disposal apparatus for use in an industrial cleaning system.

The invention also relates an industrial cleaning system employing the waste liquid disposal apparatus.

The invention further relates a method for disposing of waste liquid in an industrial cleaning system.

Industrial cleaning systems for cleaning floors in buildings often employ cleaning units with means thereon to carry both cleaning liquid, such as water mixed with detergent, and the dirty or waste liquid collected by the cleaning unit. As a result, the cleaning operation must be frequently interrupted to both obtain a supply of fresh cleaning liquid, and to empty the waste liquid. In addition, the cleaning unit is large and awkward to handle.

To speed up the cleaning operation, it is known to connect the cleaning unit with flexible hoses to both a source of water and to a drain in a sink or a tub (see for example, U.S. Pat. Nos. 3,747,155 and 3,774,260, both of 1973; 4,112,538 of 1978 and 4,226,000 of 1980). The water source usually comprises a tap in a sink. A first flexible hose connects the tap to the cleaning unit. At the cleaning unit, an additive such as a detergent is mixed with the water to provide a cleaning liquid which is then applied to a floor by the cleaning unit to clean the floor. The cleaning unit also collects the dirty or waste liquid off the floor and delivers it via a second flexible hose to he drain. This system permits cleaning without requiring frequent shutdowns to obtain more cleaning liquid and to dispose of the waste liquid.

However, problems are often encountered in disposing of the waste liquid down a drain. The drain often becomes clogged with debris in the waste liquid. In addition, the cleaning unit must carry the means for adding additives to the water, and the means for moving the waste liquid to the drain. Thus the cleaning unit is still quite cumbersome and awkward to handle.

It is an object of the present invention to provide an industrial cleaning system having a cleaning unit which is more compact and thus easier to handle than known cleaning units.

It is another object of the present invention to provide an industrial cleaning system having means for disposing of the waste liquid in a manner to avoid clogged drains. It is a further object of the present invention to provide a waste liquid disposal apparatus for use in an industrial cleaning system.

It is yet another object of the present invention to provide a novel method for disposing of waste liquid in an industrial cleaning system.

In accordance with one aspect of the present invention, there is provided an industrial cleaning system having a waste liquid disposal apparatus and a cleaning liquid preparation unit which are separate and remote from the movable cleaning unit itself but connected thereto with flexible hoses. As a result, the cleaning unit is quite light and compact, and easy to handle as compared to the cleaning units which carry the cleaning liquid preparation unit and the waste liquid disposal means.

The waste liquid disposal apparatus comprises a waste liquid accumulation tank which is shaped to sit on a standard toilet bowl. Means such as suction creating means are connected to the tank to cause discharge of waste liquid into the tank from the cleaning unit. When a predetermined amount of waste liquid has collected in the tank, control means switches off the aforesaid means and allows the liquid to be automatically dumped by gravity into the toilet to dispose of it. Since the outlet from a toilet bowl is quite a bit larger than sink or tub drains, there is less chance of the outlet becoming clogged with debris.

In another aspect, the invention is directed toward a method for disposing of waste liquid from an industrial cleaning system, which method comprises the steps of mounting a waste liquid accumulation tank on a draining means such as a toilet bowl; delivering waste liquid to the tank; and automatically emptying the waste liquid from the tank into the draining means when the liquid in the tank has reached predetermined high level.

Preferably, the method comprises the step of exhausting air from the tank to draw waste liquid into the tank. In this particular embodiment, the waste liquid is emptied from the tank by determining the amount of waste liquid delivered to the tank, stopping exhausting air from the tank to let the waste liquid flow by gravity into the draining means when the determined amount of waste liquid has reached a predetermined high level, and restarting exhausting air from the tank as soon as the waste liquid has reached a predetermined low level.

According to yet another aspect, the invention is directed toward a waste water disposal apparatus for use in an industrial cleaning system, which comprises a waste liquid accumulation tank; means on the tank for mounting it on a toilet bowl; a waste liquid inlet on the tank; and means for automatically emptying waste liquid from the tank into a toilet when the liquid in the tank has reached a predetermined high level.

Preferably, the apparatus also comprises means connected to the tank for withdrawing air from within the tank to draw waste liquid.

In accordance with a preferred embodiment of the invention, the means for emptying waste liquid from the tank comprise a bottom outlet, a dump valve normally closing the outlet, sensing means for determining the level of waste liquid in the tank, and control means for automatically switching off the air withdrawing means when the sensing means has detected a predetermined high liquid level and for re-switching on said air withdrawing means when the sensing means has sensed a low level of waste water, the dump valve automatically pivoting to an open position under the weight of the waste liquid when the air withdrawing means are switched off, and letting said waste liquid flow by gravity into the draining means.

The invention is further directed toward an industrial cleaning system comprising a cleaning unit connectable to a source of liquid; a unit for adding and mixing at least one cleaning additive to the liquid before it reaches the cleaning unit; a waste liquid disposal apparatus; a waste liquid conduit connecting the cleaning unit to the disposal apparatus, and means connected to the disposal apparatus for causing discharge of waste liquid from the cleaning unit to the disposal apparatus through the waste liquid conduit. In accordance with the invention this system is characterized in that the waste liquid disposal apparatus is of the same type as above.

Figure 2:
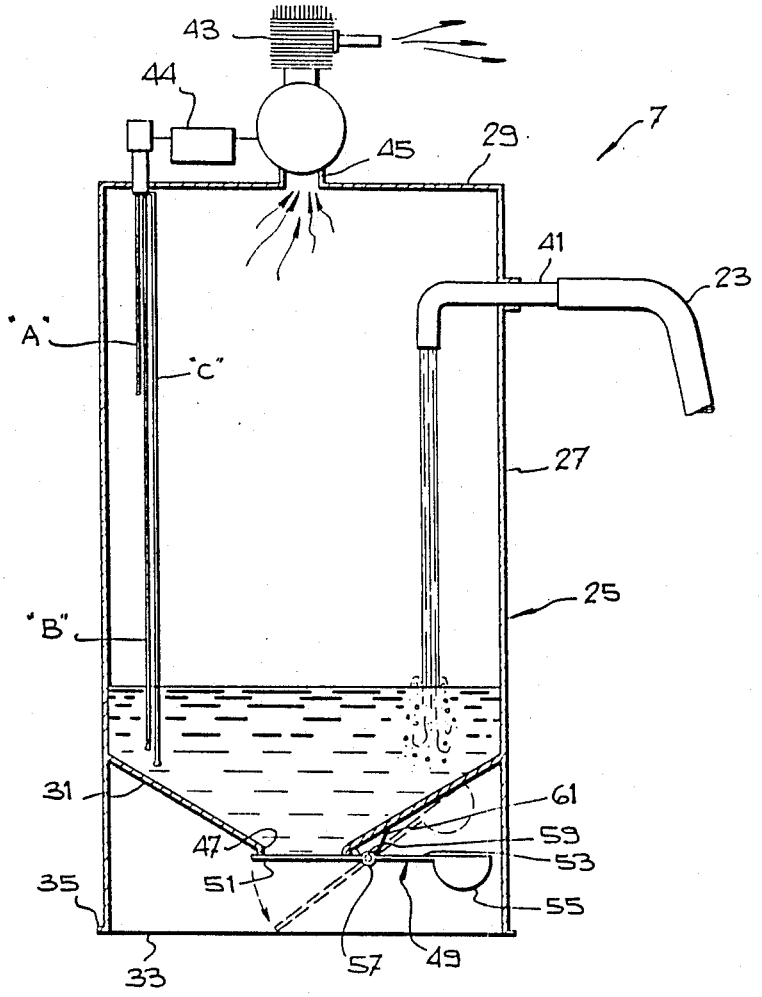
Figure 3:
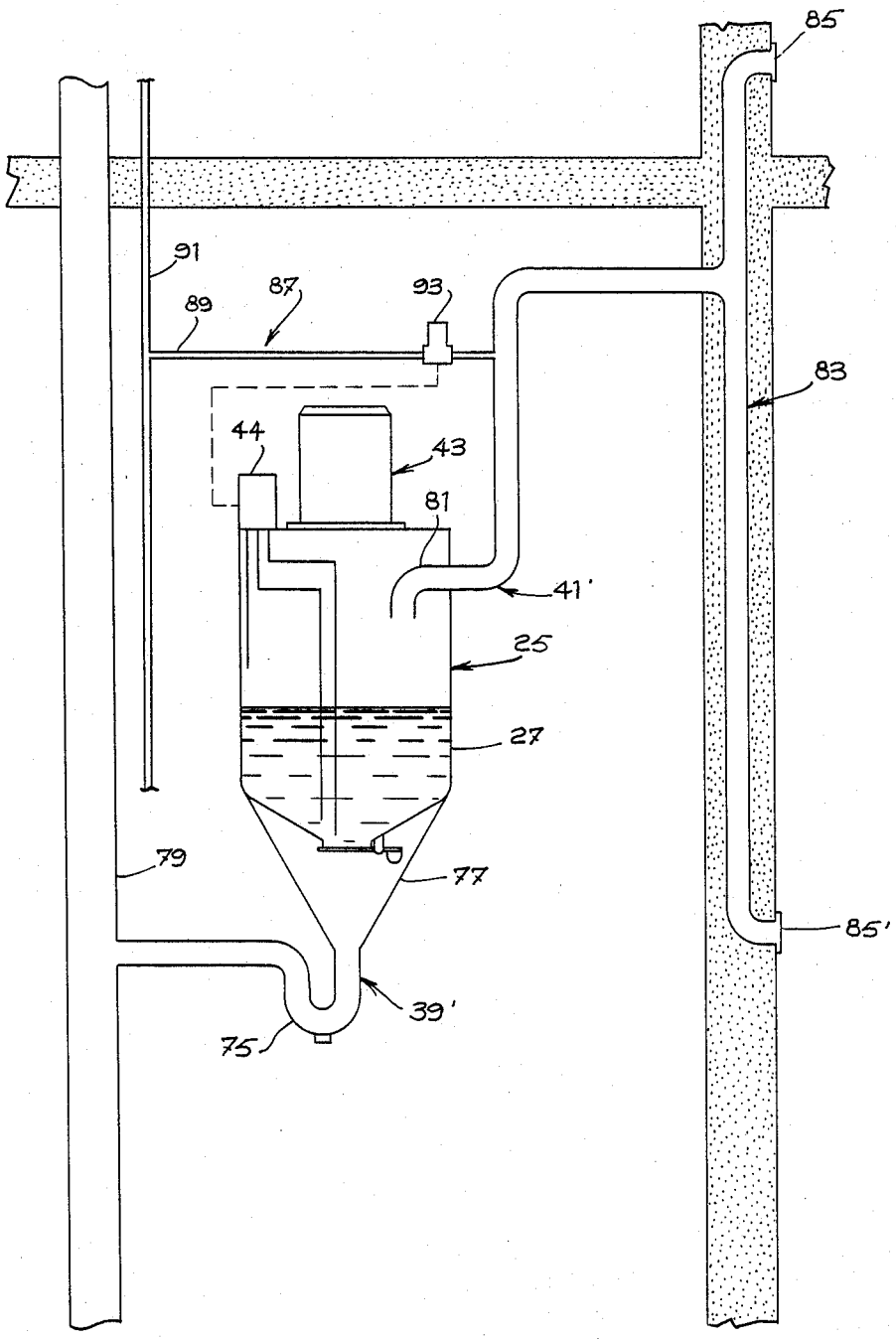

A preferred embodiment of the invention will now be described in detail having reference to the accompanying drawings in which:

FIG. 1 is a schematic view of an industrial cleaning system using a waste liquid disposal apparatus according to the present invention; and FIG. 2 is a cross-section view of the waste liquid disposal apparatus shown in FIG. 1, and FIG. 3 is a side elevation view, partly in section, illustrating a waste water disposal apparatus according to another preferred embodiment.

The industrial cleaning system 1, shown in FIG. 1, basically comprises a mobile floor cleaning unit 3, a cleaning liquid preparation unit 5, and a waste liquid disposal unit 7. A first flexible hose 9 connects the unit 5 to a source of liquid such as a water tap 11 of a wash-basin 13. A second flexible hose 15 connects the unit 5 to the cleaning unit 3. Additives, such as a detergent, are added to the water in the cleaning liquid preparation unit 5 from at least one storage container 17. A mixer 18 in the unit 5, thoroughly mixes the additives and water before they are sent to the cleaning unit 3.

The unit 5 further comprises a pressure pump 19 for pumping and pressurizing the cleaning liquid prior to supplying it to the cleaning unit 3, if desired.

The cleaning unit 3 spreads the cleaning liquid on a floor 21 and brushes the floor clean. The dirty, waste liquid is thereafter collected by the cleaning unit 3 and the waste liquid is moved through a third flexible hose 23 to the waste liquid disposal apparatus 7.

The waste liquid disposal apparatus 7 comprises a closed accumulation tank 25. As shown in FIG. 2, the tank 25 has a side wall 27, a top wall 29 and a bottom wall 31. The bottom wall 31 is positioned upwardly a short distance from the bottom edge 33 of the side wall 27. A flange 35 is provided on the bottom edge 33 of the side wall 27.

As clearly shown in FIG. 1, the bottom edge 33 of the tank 25 is sized to seat the tank 25 on a suitable draining means such as on the upper edge 37 of a standard toilet bowl 39.

An inlet tube 41 is mounted in the side wall 27 of the tank 25 near its top wall 29. This inlet tube 41 is connected to the flexible hose 23 outside the tank 25. An air suction pump and motor unit 43 is mounted on the top wall 29 of the tank 25 for removing air from the tank 25 through an air outlet 45. The suction pump and motor unit 43 creates, in the tank 25, a vacuum which allows the cleaning unit 3 to collect the waste liquid from the floor, to draw it from the cleaning unit 3 and to discharge it into the tank 25 via the hose 23.

The bottom wall 31 of tank 25 slopes downwardly towards a central liquid outlet 47. A dump valve 49 normally closes the outlet 47. The valve 49 has a closure plate 51 which is sized to cover outlet 47. An arm 53 extends from plate 51 toward the side wall 27 of the tank 25. A counterweight 55 is mounted on the free end of the arm 53 normally to keep the dump valve 49 closed. A pivot mounting 57 is provided on the arm 53 near the plate 51. It includes a horizontal pivot pin 59 which connects the valve 49 via this pivot mounting 57, to a bracket 61 mounted on the outside of bottom wall 31 adjacent the outlet 47.

The waste liquid disposal apparatus 7 further comprises a set of electrodes <A>, <B> and <C> acting as sensing means for sensing liquid levels suitable to determine the amount of waste water inside the tank 25. Electrode <A> extends vertically inside the tank to a short distance from the top while electrodes <B> and <C> extend vertically down to a short distance from the bottom of the tank. Electrodes <A> and <B> respectively correspond to an upper level and a lower level of waste liquid inside the tank. Electrode <C> is a contact electrode which cooperates with either of electrode <A> or <B> to switch off or switch on the suction pump and motor unit 43 via a control circuit 44.

In operation, the accumulation tank 25 is mounted on the upper edge 37 of a toilet bowl 39 so that its liquid outlet 47 may empty into the bowl 63 of the toilet. The waste liquid hose 23 is connected between the cleaning unit 3 and the inlet tube 41 on tank 25 and the first hose 9 is connected to the tap 11. The tap 11 is then opened and the cleaning unit 3 is operated to clean the floor 21 with water mixed in the unit 5 with additives such as a detergent. At the same time, the suction pump and motor unit 43 is started to create a vacuum within the tank 25 to thereby draw into it the waste water which is collected by the cleaning unit 3 from the floor 21. The outlet 47 in the tank 25 is closed by the dump valve 49 as long as the air pump and motor unit 43 is in operation, due to the vacuum created inside the tank 25. The dump valve 49 remains closed by the vacuum while the waste water, drawn from the cleaning unit 3, collects into the tank 25. When the waste water reaches the upper electrode <A>, the suction pump and motor unit 43 is stopped by the control circuit. Then the valve 49 opens due to the weight of the water, emptying the tank 25 and flush the waste water into the toilet bowl 63. As soon as the falling waste water level inside the tank 25 reaches the level of the electrode <B>, the suction pump and motor unit 43 is reenergized by the control circuit for another cycle of operation. The valve 49 closes the outlet 47 in the tank 25, due to its counterweight 55 and to the re-activated vacuum, in order to collect more waste water.

The control circuit connected to the electrodes can be of any type. It can be electronic or electromechanical and therefore it is believed that no further description of it is necessary.

The above described embodiment of the invention is of course merely examplary. Indeed, it is obvious that the invention is susceptible of modification, variations and changes without departing from the scope and fair meaning of the invention as defined in the appended claims.

Thus, suitable provision should be made to cut-off the pump and motor unit 43, automatically after a predetermined period of time and/or manually, to prevent uninterrupted operation of the unit 43 should filling of the tank 25 with waste water be discontinued before the level reach the top electrode A.

Another particularly interesting embodiment of the invention lies in the possibility of permanently mounting the waste water disposal apparatus described above in a building, the apparatus being provided with a special waste-water pick-up arrangement having one end discharging waste water into the accumulation tank whereas several other ends are provided, each opening into one of the rooms of the building. Such an arrangement is diametrically illustrated in FIG. 3, partially shown in cross-section.

With reference to this FIG. 3, the accumulation tank 25 and suction pump 43 are the same as those described with respect to the embodiments of FIGS. 1 and 2.

The draining means 39', however, is in the form of a conventional water plug drain 75 having, integrally provided at its upper end, a funnel-shaped member 77 fixedly secured, as by welding or otherwise, to the bottom of the accumulation tank 27. The other end of the water-plug drain is connected to the waste water connecting drain pipe 79 of the building.

As to the inlet means 41', it is a piping arrangement having an inlet end 81 discharging into the accumulation tank 27, this inlet end being operatively connected to a piping circuit 83 formed of a plurality of conduits each having end 85, 85', each such end opening into one of the rooms of the building. These ends 85, 85', are normally closed by any known spring-loaded valves.

In use, the free end of the third hose 23 of the mobile floor cleaning unit 3 (FIG. 1) is plugged into the relevant pipe end 85, 85', and, in known manner, the arrangement is such as to energize the suction pump 43 to place the accumulation tank 27 under vacuum, in the manner described in the principal disclosure. The rest of the operation is as described previously.

The advantage of such a system is that it may also be used for the dust cleaning of floors or the like with the simple inclusion of a water source 87 feeding into the inlet end 81 to capture dust and carry it into the accumulation tank 25. The source 87 may simply be a branch line 89 connected, at one end, to the inlet end 81 and, at the other end, to a water line 91. An electrically actuated valve 93 is connected to the aforesaid control circuit 44 so that the valve may become operative at the same time as the motor and suction pump unit 43.

I claim:

1. A waste water disposal apparatus, for particular use in an industrial cleaning system, comprising:

a waste liquid accumulation tank;

means on said tank for the mounting thereof over a draining means;

inlet means on said tank for the ingress of waste water thereinto;

means on said tank to cause discharge of said waste water into said tank through said inlet means, said means to cause discharge of waste water into said tank comprising:

means connected to said tank for withdrawing air therefrom to create a vacuum suitable to draw waste water therein from said inlet means, means for automatically flushing waste liquid from said tank into said draining means when said waste liquid has reached a predetermined high level in said tank, said means for automatically flushing were liquid from said tank comprising:

a bottom wall on said tank defining a waste water outlet;

a dump valve normally closing said outlet;

means for sensing high and low levels of waste liquid in said tank, said sensing means comprising a set of electrodes extending vertically into said tank with the ends thereof located at different heights corresponding to said high and low levels, control means for automatically switching said air withdrawing means off when said high level in said tank is reached and for switching said air withdrawing means on when said low level in said tank is reached, and pivot means mounting said dump valve on the bottom wall of said tank whereby said dump valve automatically pivots to open position under the weight of said waste liquid in said tank when said air withdrawing means is switched off, to allow said waste liquid to be flushed by gravity into said draining means.

2. A disposal apparatus as claimed in claimed in claim 1, wherein said tank has a bottom edge and said bottom wall is spaced upwardly from said bottom edge, said waste water outlet being located at the center of said bottom wall.

3. An industrial cleaning system comprising:

a movable cleaning unit;

a cleaning liquid preparation unit having means for connecting a source of water thereto;

flexible fluid flow means interconnecting said cleaning liquid preparation unit and said movable cleaning unit to supply cleaning liquid to said cleaning unit;

a waste liquid disposal apparatus and flexible fluid flow means connecting said apparatus and said cleaning unit for the transfer of waste liquid from said cleaning unit to said apparatus, wherein said apparatus comprises:

a waste liquid accumulation tank;

means on said tank for removably mounting said tank over a draining means;

inlet means on said tank for the ingress of waste water thereinto;

means on said tank which causes discharge of said waste water into said tank through said inlet means, said means that causes discharge of waste water into said tank comprising means connected to said tank for withdrawing air therefrom to create a vacuum suitable to draw waste water therein from said inlet means, said vacuum creating means being a suction pump mounted on the top of said accumulation tank, means for automatically flushing waste liquid from said tank into said draining means when said waste liquid has reached a predetermined high level in said tank, said means for automatically flushing waste liquid from said tank comprising:

a bottom wall on said tank defining a waste water outlet;

a dump valve normally closing said outlet;

means for sensing high and low levels of waste liquid in said tank, said sensing means comprising a set of electrodes extending vertically into said tank with the ends thereof located at different heights corresponding to said high and low levels.

control means for automatically switching said air withdrawing means off when said high level in said tank is reached and for switching said air withdrawing means on when said low level in said tank is reached, and pivot means mounting said dump valve on said tank whereby said dump valve automatically pivots to open position under the weight of said waste liquid in said tank when said air withdrawing means are switched off, to allow said waste liquid to be flushed by gravity into said draining means.

4. A system as claimed in claim 3, wherein said tank has a bottom edge and said bottom wall is spaced upwardly from said bottom edge, said waste water outlet being located at the center of said bottom wall.

5. A system as claimed in claim 3 further comprising a pressure pump operatively connected between said cleaning liquid preparation unit and said cleaning unit for increasing the pressure of the cleaning liquid supplied to the cleaning unit.

6. A combination waste water near disposal and drainage apparatus for use in a building having a plurality of rooms, said apparatus comprising:

a waste liquid accumulation tank;

connecting means on said tank for connecting said tank to a draining means;

inlet means on said tank for the ingress of waste water thereinto;

means on said tank to cause discharge of said waste water into said tank through said inlet means, and said means to cause discharge of waste water into said tank comprising;

means connected to said tank for withdrawing air therefrom to create a vacuum suitable to draw waste water therein from said inlet means;

means for automatically flushing waste liquid from said tank into said draining means when said waste liquid has reached a predetermined high level in said tank;

said means for automatically flushing waste liquid from said tank comprise:

a bottom wall on said tank defining a waste water outlet;

a dump valve normally closing said outlet;

means for sensing high and low levels of waste liquid in said tank, said sensing means comprising a set of electrodes extending vertically into said tank with the ends thereof located at different heights corresponding to said high and low levels;

control means for automatically switching said air withdrawing means off when said high level in said tank is reached and for switching said air withdrawing means on when said low level in said tank is reached, and pivot means mounting said dump valve on the bottom wall of said tank whereby said dump valve automatically pivots to open position under the weight of said waste liquid in said tank when said air withdrawing means is switched off, to allow said waste liquid to be flushed by gravity into said draining means wherein:

said draining means is in the form of a water plug drain; and said tank connecting means comprise a funnel-shaped member solid with the bottom of said tank, around said tank waste water outlet, and solid with an upper end of said water plug drain.

7. An apparatus as claimed in claim 6, wherein said tank inlet means comprise: conduit means including a pipe inlet opening into said tank and a piping circuit connected to said pipe inlet and having a plurality of plug-in means, each plug-in means being adapted to correspond to one of said rooms.

8. An apparatus as claimed in claim 6, further including dust collecting water means connected to said pipe means to feed water thereinto and including an electrically operated valve and means connecting said valve to said control means to cause operation of said valve simultaneously with said air withdrawing means.

9. An apparatus as claimed in claim 8, said system further comprising: said draining means in the form of a water plug drain, and wherein said tank mounting means comprise a funnel-shaped member solid with the bottom of said tank, around said tank waste water outlet, and solid with an upper end of said water plug drain.

* * * * *